US008708608B2

(12) United States Patent
Bott

(10) Patent No.: US 8,708,608 B2
(45) Date of Patent: Apr. 29, 2014

(54) STACKABLE SEGMENTAL RETAINING WALL BLOCK

(75) Inventor: Timothy A. Bott, Sunfish Lake, MN (US)

(73) Assignee: Allan Block LLC, Edina, MN (US)

( * ) Notice: Subject to any disclaimer, the term of this patent is extended or adjusted under 35 U.S.C. 154(b) by 168 days.

(21) Appl. No.: 12/882,257

(22) Filed: Sep. 15, 2010

(65) Prior Publication Data

US 2012/0063853 A1 Mar. 15, 2012

(51) Int. Cl.
*E02D 29/02* (2006.01)

(52) U.S. Cl.
USPC ..... 405/286; 405/284

(58) Field of Classification Search
USPC ..... 405/262, 284, 286; 52/604, 606
See application file for complete search history.

(56) References Cited

U.S. PATENT DOCUMENTS

| | | | |
|---|---|---|---|
| 1,329,893 | A | 2/1919 | Flynn |
| 1,405,995 | A | 2/1922 | Flynn |
| 3,379,017 | A | 4/1968 | Kusatake |
| 3,464,211 | A | 9/1969 | Andersen |
| 4,597,236 | A | 7/1986 | Braxton |
| 4,815,897 | A | 3/1989 | Risi et al. |
| 4,889,310 | A | 12/1989 | Boeshart |
| 4,896,999 | A | 1/1990 | Ruckstuhl |
| 4,909,010 | A | 3/1990 | Gravier |
| 5,315,802 | A | 5/1994 | Hart |
| 5,337,527 | A | 8/1994 | Wagenaar |
| 5,350,256 | A | 9/1994 | Hammer |
| 5,474,405 | A | 12/1995 | Anderson et al. |
| 5,484,236 | A | 1/1996 | Gravier |
| 5,623,797 | A | 4/1997 | Gravier et al. |
| 5,688,078 | A | 11/1997 | Hammer |
| 5,707,184 | A | 1/1998 | Anderson et al. |
| 5,788,423 | A | 8/1998 | Perkins |
| 5,820,304 | A | 10/1998 | Sorheim et al. |
| 5,878,545 | A | 3/1999 | Gebhart |
| 6,062,772 | A | 5/2000 | Perkins |
| 6,082,067 | A | 7/2000 | Bott |
| 6,082,933 | A | 7/2000 | Maguire et al. |
| 6,189,282 | B1 | 2/2001 | VanderWerf |
| D459,487 | S | 6/2002 | Bott |
| 6,523,317 | B1 | 2/2003 | Bott et al. |
| 6,745,537 | B1 | 6/2004 | Hamilton |
| 6,854,236 | B2 | 2/2005 | Bott |

(Continued)

FOREIGN PATENT DOCUMENTS

| | | |
|---|---|---|
| EP | 0112213 A1 | 6/1984 |
| FR | 1012498 A | 7/1952 |

(Continued)

OTHER PUBLICATIONS

"PCT International Search Report dated Mar. 18, 2011 for related PCT/US2009/060336," 4 pgs.

(Continued)

*Primary Examiner* — Benjamin Fiorello
(74) *Attorney, Agent, or Firm* — Fredrikson & Byron, P.A.

(57) ABSTRACT

A multi-component segmented retaining wall (SRW) block that may form a mortarless retaining wall. Each SRW block includes an interlocking face unit and an anchor unit that may be interlocked by complementary connector elements. The face units each have a front face that has one or more coplanar stacking surfaces to provide greater stability when the face units are stacked for shipping.

19 Claims, 11 Drawing Sheets

(56) References Cited

U.S. PATENT DOCUMENTS

| | | | | |
|---|---|---|---|---|
| 6,948,282 | B2 | 9/2005 | Bott | |
| 7,198,435 | B2 | 4/2007 | Dolan et al. | |
| 7,207,146 | B1 | 4/2007 | Morrell | |
| 7,410,328 | B2 | 8/2008 | Hamel | |
| 7,775,747 | B2 | 8/2010 | Bott | |
| D667,141 | S | 9/2012 | Bott | |
| 2001/0029717 | A1 | 10/2001 | Spakousky | |
| 2004/0161307 | A1 | 8/2004 | Hammer | |
| 2005/0254906 | A1 | 11/2005 | Dolan et al. | |
| 2006/0239784 | A1 * | 10/2006 | Price et al. | 405/284 |
| 2007/0196184 | A1 | 8/2007 | Hammer et al. | |
| 2007/0292216 | A1 | 12/2007 | Hamel | |
| 2010/0018146 | A1 | 1/2010 | Aube et al. | |

FOREIGN PATENT DOCUMENTS

| | | | |
|---|---|---|---|
| FR | 2536777 | A1 | 6/1984 |
| FR | 2542783 | A2 | 9/1984 |
| JP | 2000230240 | | 8/2000 |
| WO | 8808063 | | 10/1988 |

OTHER PUBLICATIONS

"PCT Written Opinion dated Mar. 18, 2011 for related PCT/US2009/060336," 4 pgs.

"PCT International Preliminary Report on Patentability dated May 10, 2011 for related PCT/US2009/060336," 5 pgs.

Brochure, The next generation segmental retaining wall system . . . Gravity Stone, Westblock Products, Inc., patent pending 1992, 2 pgs.

* cited by examiner

STACKABLE SEGMENTAL RETAINING WALL BLOCK

TECHNICAL FIELD

The present disclosure pertains segmental retaining wall block, and more particularly to stackable segmental retaining wall blocks.

BACKGROUND

Retaining walls are commonly employed to retain highly positioned soil, such as soil forming a hill, to provide a usable level surface therebelow such as for playgrounds and yards, or to provide artificial contouring of the landscape which is aesthetically pleasant. Such walls have been made of concrete blocks having various configurations, the blocks generally being stacked one atop another against an earthen embankment with the wall formed by the blocks extending vertically or being formed with a setback. Setback is generally considered to be the distance in which one course of a wall extends beyond the front of the next highest course of the same wall. Concrete blocks have been used to create a wide variety of mortared and mortarless walls. Such blocks are often produced with a generally flat rectangular surface for placement onto the ground or other bearing foundation and for placement onto lower blocks in erecting the wall. Such blocks are also often further characterized by a frontal flat or decoratable surface and a flat planar top for receiving and bearing the next course of blocks forming the wall.

It is generally desired that retaining walls of the type described exhibit certain favorable characteristics, among which may be mentioned the ease with which the retaining wall can be assembled, the stability of the wall (that is, its ability to maintain structural integrity for long periods of time), and the ability of the wall to admit and disburse rainwater. Although retaining wall blocks commonly are supported vertically by resting upon each other, it is important that the blocks be restrained from moving outwardly from the earthen wall that they support.

Current manufacturing techniques and the economics associated therewith limit the shapes, sizes, and materials that may be used to manufacture blocks that still provide the functions described above. In some instances, it would be preferred to make blocks in different shapes, sizes, and colors, and using different quality, types, and price of materials, and possibly in a centralized location which may be further from their point of use. Accordingly, the SRW blocks must be transported to the installation location. When SRW blocks are transported to the installation location, they are typically stacked on a pallet for easier transportation. Surfaces of many types of SRW blocks are often designed to be irregular so that the SRW blocks better simulate natural stone. However, such surface irregularities can present problems when transporting SRW blocks. For instance, when the surface irregularities come in the form of differing block depths, the SRW blocks may not stack evenly. Blocks that do not stack evenly can result in stacks that are not of uniform size. For instance, one row may lean heavily in a particular direction. This risks having the shipment not fit in or on its transporting vehicle. Of greater concern, though, are that blocks that do not stack evenly may be less stable than desired. That is, irregular surfaces sometimes do not provide a stable base for subsequently stacked layers. It is desirable to both break through these boundaries and yet produce improved retaining wall blocks.

SUMMARY OF THE INVENTION

Certain embodiments of the present disclosure pertain to a mortarless retaining wall constructed of a plurality of segmental retaining wall (SRW) blocks stacked in an array of superimposed rows. Each SRW block includes a face unit and one or more anchor units. Each face unit has connectors, a front face, and a rear face where the front face defines at least part of the exposed surface of the retaining wall. The one or more anchor units have connectors that are of complementary shape to the face unit connectors in order to interlock to form an SRW block. Each anchor unit is adapted to confront soil being retained by the retaining wall. The face unit and each anchor unit each have upper and lower load bearing surfaces. These surfaces are shaped to mate together when one SRW block is stacked on another SRW block and to resist shear forces generated by the soil being retained by the retaining wall. A portion of the face unit rear face includes a generally planar rear surface. A portion of the front face includes one or more coplanar stacking surfaces oriented parallel to the generally planar rear surface. The maximum depth of the face unit is the distance between the stacking surfaces and the rear surface. The front face also includes an irregularly patterned surface simulating natural stone that extends from one or more of the stacking surfaces towards the rear face.

Certain embodiments of the present disclosure pertain to a plurality of SRW blocks for stacking in an array of superimposed rows to form a retaining wall. Each SRW block includes a face unit and one or more anchor units. The face unit has a front face and a rear face where the front face defines at least part of the exposed surface of the retaining wall. The face unit and the anchor unit have connectors shaped to interlock together to form the SRW block. Each anchor unit is adapted for confronting soil that is retained by the retaining wall. The face unit and anchor units each have upper and lower load bearing surfaces that are shaped to mate together and resist shear forces generated by the soil between SRW blocks when one SRW block is stacked on another block. A portion of the face unit rear surface is generally planar. A portion of the front surface includes one or more coplanar stacking surfaces oriented parallel to the rear surface. The maximum depth of the face unit is the distance between the stacking surfaces and the rear surface. The front face includes non-planar surfaces extending from one or more of the stacking surfaces toward the rear face.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the invention.

Figure 1:
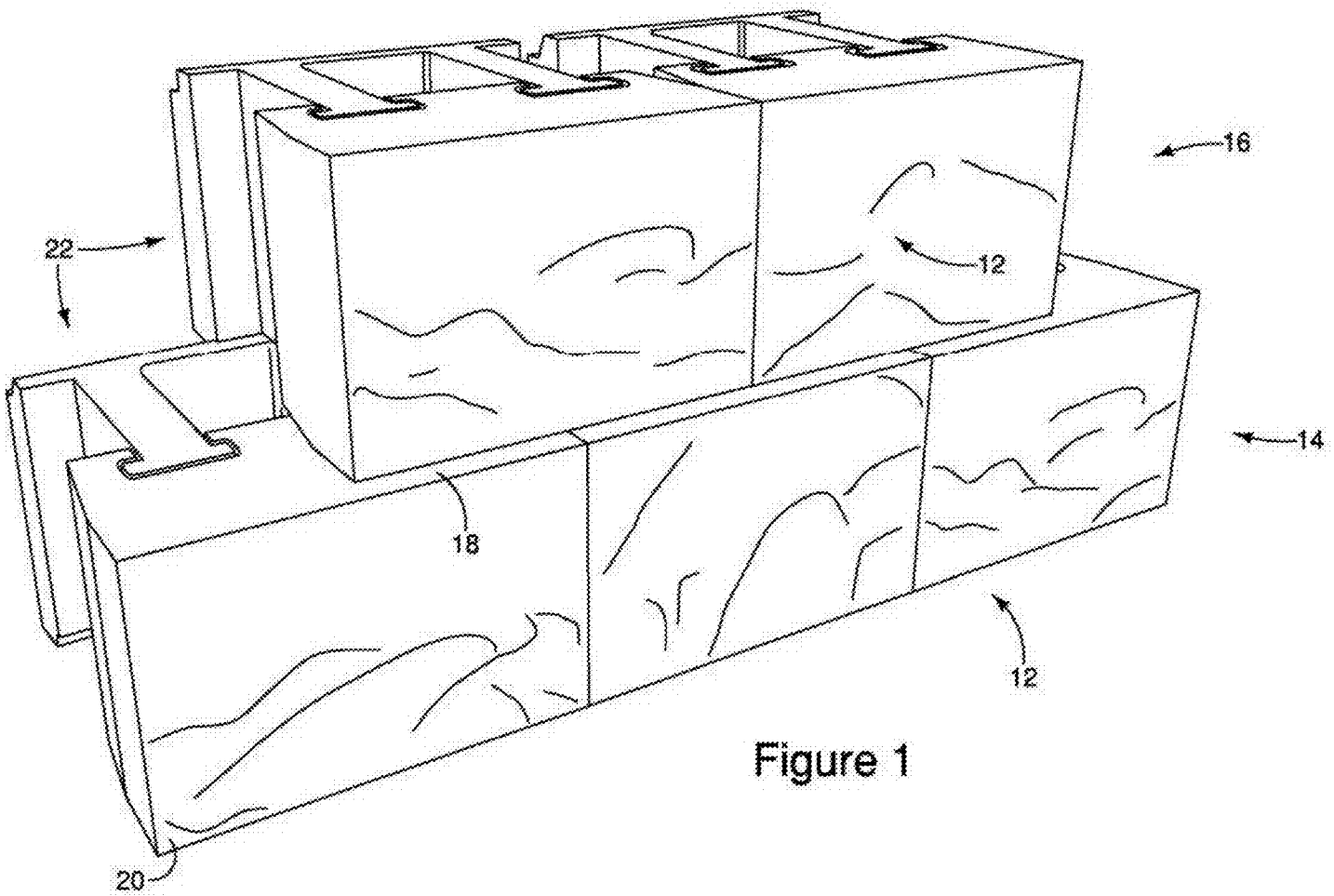
FIG. 1 is a front perspective view of a mortarless retaining wall constructed of a plurality of multi-component segmented retaining wall (SRW) blocks according to some embodiments of the present invention.

FIG. 1 is a front perspective view of a mortarless retaining wall 10 constructed of a plurality of multi-component segmented retaining wall (SRW) blocks 12 according to some embodiments of the present invention. As illustrated, the wall 10 consists of a first course 14 of SRW blocks 12 and a second course 16 of SRW blocks 12 stacked over the first course 14. Any number of courses are within the scope of the present invention. The second course 16 is constructed with a setback 18 relative to the first course 14. As described further below, any level of setback, including no setback, is within the scope of the present invention. In addition, the second course 16 could even be set forward relative to the first course 14, either for the entire course or just intermittently within the second course. The front faces 20 of blocks 12 on the wall 10 are typically exposed as shown. The back sides 22 of blocks 12 on the wall 10, however, are typically hidden from view and are confronting soil (not shown) being retained in place by the wall 10. The soil, of course, creates pressure on the back side 22 of the wall 10 and its SRW blocks 12, tending to push the SRW blocks 12 forward.

Figure 2A:
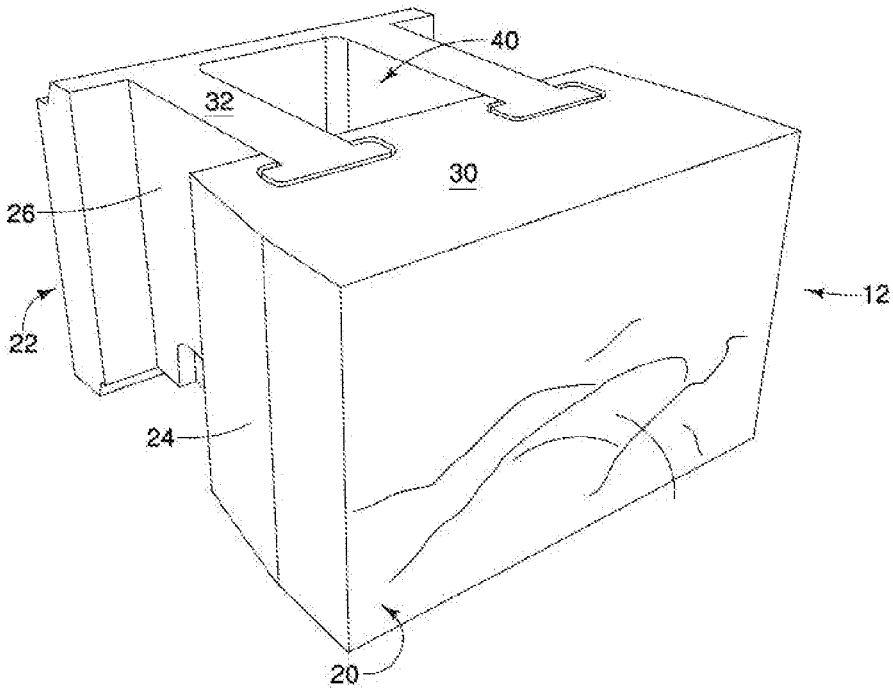
FIG. 2A is a front perspective view of a multi-component SRW block according to some embodiments of the present invention.
Figure 2B:
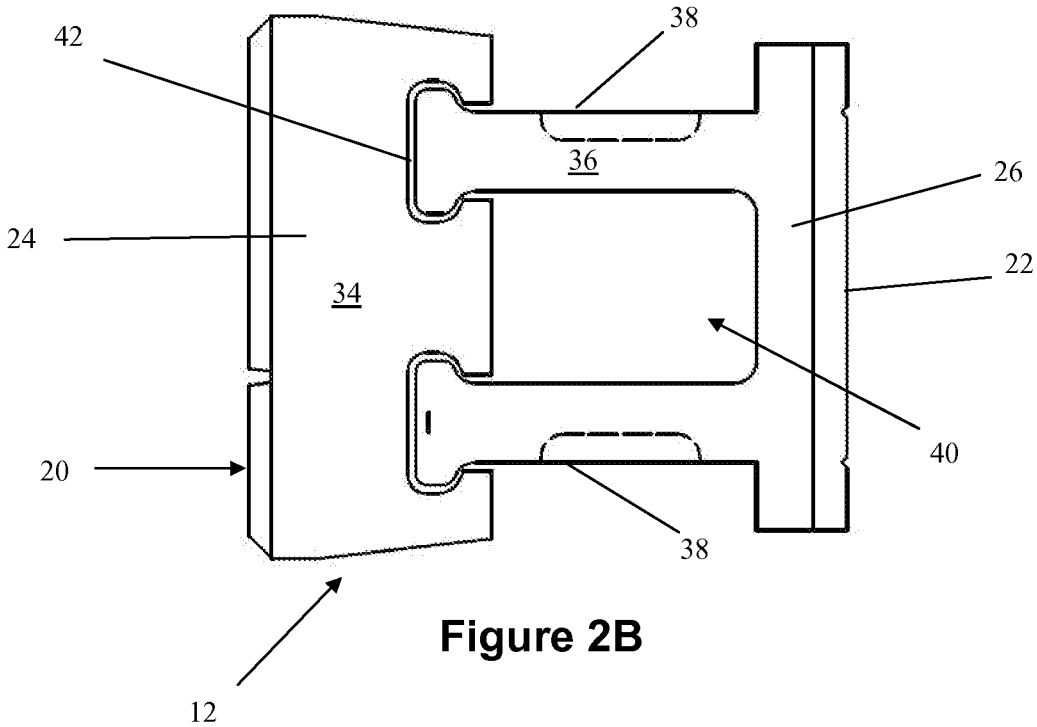
FIG. 2B is a bottom view of a multi-component SRW block according to some embodiments of the present invention.

FIG. 2A is a front perspective view of a multi-component SRW block 12 according to some embodiments of the present invention. FIG. 2B is a bottom view of a multi-component SRW block 12 according to some embodiments of the present invention. As shown, the SRW block 12 is comprised of two components, a face unit 24 and an anchor unit 26, interlocked together via respective connector elements. The face unit 24 has a front face 20 that defines part of the exposed surface of the retaining wall. The face unit 24 also has two connector elements described further below. The anchor unit 26 has a back side 22 against which soil bears and is retained by the back side 22. The anchor unit 26 also has two connector elements of complementary size and shape to respective connector elements of the face unit. Several advantages are realized by forming SRW block 12 of two interlockable components. For instance, for those persons who move, stack, or otherwise handle SRW blocks from production to ultimate placement and wall assembly, it is much easier to lift, move, and accurately place a SRW block component than it is to lift, move, and accurately place an entire one-piece SRW block. Other advantages of the multi-component design are provided below.

The SRW blocks 12 in FIG. 1 are freestanding. That is, no mortar is required to form the wall. With reference again to FIGS. 2A and 2B, SRW block 12 has parallel load bearing surfaces on the top and bottom of the block. The upper load bearing surface is formed by the face unit upper surface 30 and the anchor unit upper surface 32. The lower load bearing surface is formed by the face unit lower surface 34 and the anchor unit lower surface 36. The load bearing surfaces are formed transversely to the front face 20 and the back side 22. SRW block 12 also has side walls 38 formed transversely to the upper surfaces 30, 32 and the front face 20. In the embodiment shown, the side walls 38 are formed by the anchor unit 26. In the embodiment shown, the side walls 38 extend the entire height of the SRW block, from the lower load bearing surface to the upper load bearing surface. In other embodiments, the side walls do not extend the entire distance between the upper and load bearing surfaces.

When the face unit 24 and the anchor unit 26 are interlocked, as shown in FIGS. 2A and 2B, the multi-component SRW 12 formed contains a hollow core 40. Hollow core 40 extends vertically through the SRW block from the lower bearing surface to the upper bearing surface and is bounded by inner walls of the anchor unit 26 and the face unit 24. Hollow core 40 provides several advantages. First, the central hollow core 40 also reduces the quantity of material required for production of the SRW block, which is a cost reduction feature. The hollow core 40 also reduces the weight per square foot of the SRW block without sacrificing the load bearing strength. This feature lightens the load for shipping as well as for those persons who move, stack, or otherwise handle the individual blocks from production to ultimate placement and wall assembly. The hollow core 40 of each SRW block 12 in the wall may also be filled with a rock or earthen fill to stabilize and reinforce the wall 10 against the soil pressure. Such fill may include a clean granular backfill, such as clean crushed rock or binder rock, or on-site soils such as, for example, black earth, typically containing quantities of clay and salt. As noted below, the relative positions of the face unit connectors and the anchor unit connectors form an interlock that is stabilized via the addition of fill in the hollow core 40. That is, the connectors permit relative vertical movement between the face unit 24 and the anchor unit 26 but resist and generally prevent relative longitudinal (front to back) movement and lateral (side to side) movement between the face unit 24 and the anchor unit 26. The fill adds pressure internal to SRW block 12 within the hollow core 40 to further restrict all relative movement between the face unit 24 and the anchor unit 26.

In addition, as seen in FIG. 2B, there is a small gap 42 in the interface between the connectors providing a loose connection between the face unit 24 and anchor unit 26. The small gap 42 provides for easier assembly of the anchor unit 26 and face unit 24 into a SRW block 12 and allows for limited relative movement (play) between the anchor unit and the face unit without disconnecting the interlock. With the "play" as described above, the SRW block 12 conforms better to lower courses or the terrain.

Figure 3A:
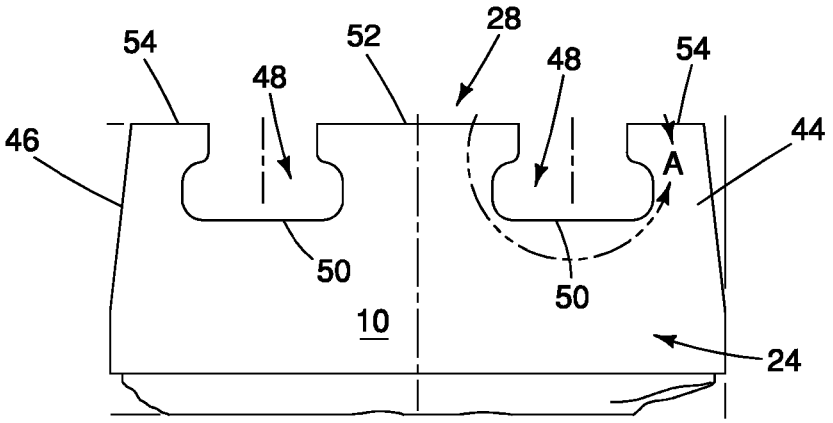
FIG. 3A is a top view of a face unit of a multi-component SRW block according to some embodiments of the present invention.
Figure 3B:
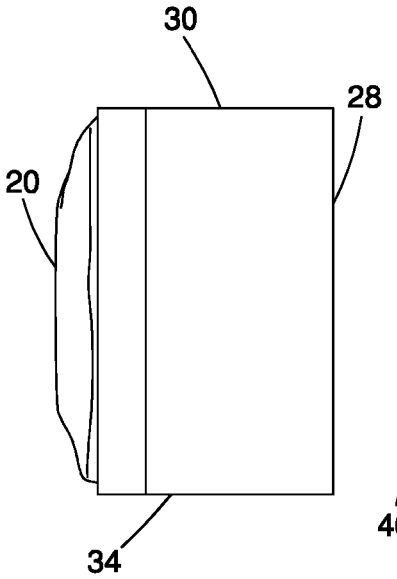
FIG. 3B is a side view of the face unit of FIG. 3A.
Figure 3C:
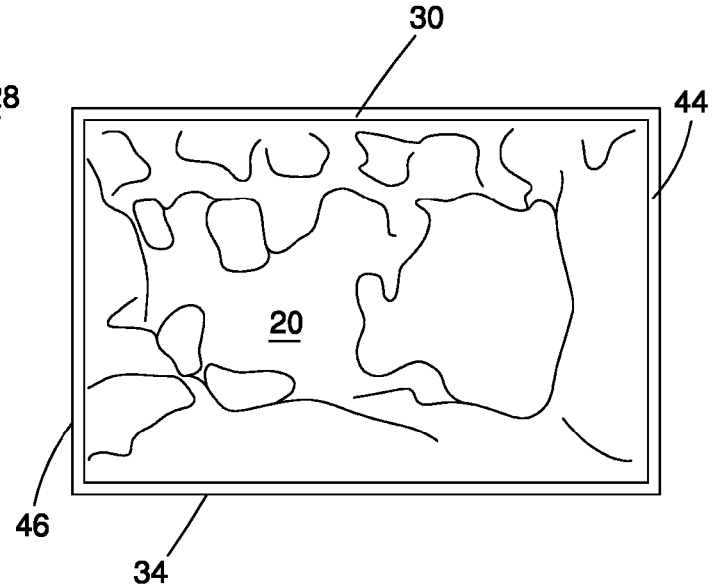
FIG. 3C is a front view of the face unit of FIG. 3A.

FIGS. 3A-3C show an embodiment of a face unit of a SRW block. FIG. 3A is a top view of a face unit 24 of a multi-component SRW block according to some embodiments of the present invention. FIG. 3B is a side view of the face unit 24 of FIG. 3A. FIG. 3C is a front view of the face unit 24 of FIG. 3A. With reference to FIGS. 3A-3C, the face unit 24 has opposing parallel front 20 and back 28 faces, opposing parallel upper 30 and lower 34 surfaces, and opposing right 44 and left 46 sides. The upper 30 and lower 34 surfaces are generally transverse to the front 20 and rear faces 28 and are substantially planar. The upper 30 and lower 34 surfaces function as load bearing surfaces, where the upper surface 30 mates with and supports the lower surface 34 of a super-imposed stacked block. Since the upper 30 and lower 34 surfaces are substantially flat, the face units 24 may be stacked with or without a setback. The front face 20 provides a stacking surface that defines part of the exposed surface of the retaining wall. The front face 20 may have a pattern molded or formed thereon, such as the pattern shown in FIG. 3C. The rear face 28 is generally planar and has two connectors 48 for interconnection with the connectors of an anchor unit. In the embodiment shown, the connectors 48 are formed as recesses or pockets in the rear face 28. The pockets are shaped as elongated keyways that run the entire height of the face unit, from the lower surface 34 to the upper surface 30. It is understood, however, that the keyway need not extend the entire height of the face unit 24. The keyways are shaped to permit relative vertical movement between the face unit 24 and the anchor unit, but to generally restrict movement in other directions. The pockets could be of other shapes long as they remain of complementary size and shape to the anchor unit connectors. The generally flat surface 50 of the pocket leaves more mass intact in the face unit and adds strength to the face unit 24. That is, the pocket extends inward less than half the depth of the face unit 24 due, in part, to the flat surface 50 formed by the pocket. Between the connectors 48 is a central portion 52 of the rear surface. Outside of the connectors 48 are outer portions 54 of the rear surface. The central portion 52 forms one of the walls of the hollow core 40 (see FIG. 2B). The face unit is about one foot wide, almost 6 inches deep and about 8 inches high. The central portion 52 of the rear face 28 is about 4 inches wide, which corresponds to the width of the hollow core. In the embodiment shown in FIGS. 3A-3C, the side walls 44, 46 of face unit 24 taper inwardly rearwardly. The taper permits the face units to be placed such that the front faces 20 are angled relative to each other. For instance, if it is desired that the retaining wall be constructed to form a convex curve (from the perspective of the front), the tapered sides 44, 46 provide adequate relief to all the face units to be angled relative to each other.

In other embodiments, one or both sides of the face unit are instead transverse to the front face 20. Accordingly, such face units may be used as part of the SRW block that forms the end block or last block in a course of blocks of a retaining wall. Moreover, in certain embodiments of the face unit, the face unit includes an alignment element formed as a lip extending laterally across the width of the upper surface of the face unit at the front of the upper surface. Accordingly, the depth or thickness of the upper lip dictates the minimum setback created by stacking subsequent courses of multi-component SRW blocks with such face units on top of each other. Setback is generally considered to be the distance in which one course of a wall extends beyond the front of the next highest course of the same wall. Also in certain embodiments of face units, the face unit includes two alignment elements—a lip, as described above, and a notch extending laterally across the width of the lower surface of the face unit at the front of the lower surface. Accordingly, the setback depth of each course of blocks is based on the difference in depths between the laterally extending lip and the notch of the face unit. In certain embodiments of face units, the face unit includes an alignment element formed as pin recesses or apertures. In some embodiments, such apertures extend vertically through the entire height of face unit. The face unit may be positioned such that one or more apertures of one face unit may be aligned the corresponding one or more apertures of subjacent and superimposed face units.

Figure 4A:
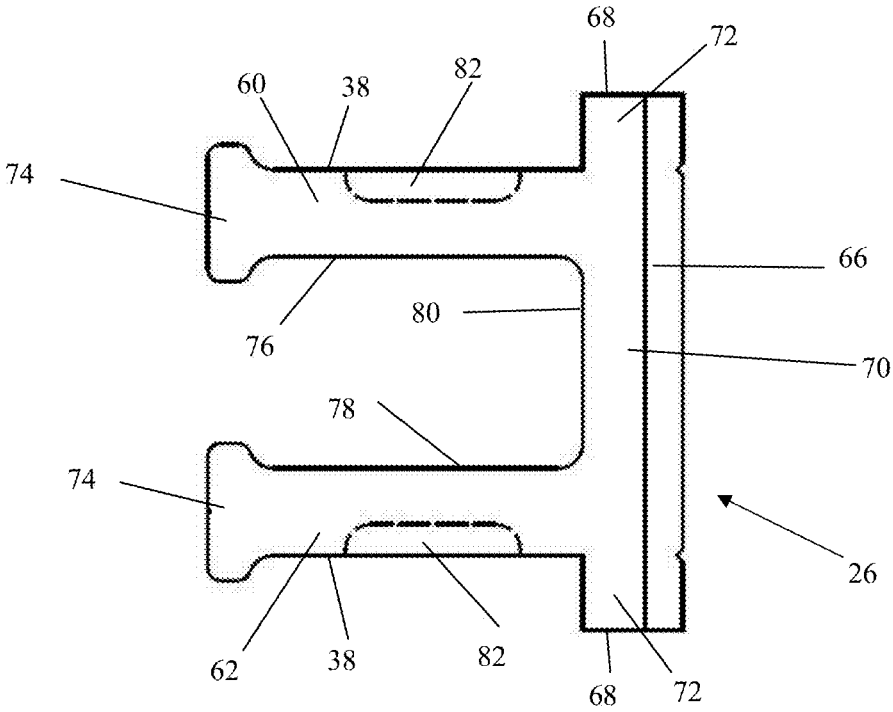
FIG. 4A is a bottom view of an anchor unit of a multi-component SRW block according to some embodiments of the present invention.
Figure 4B:
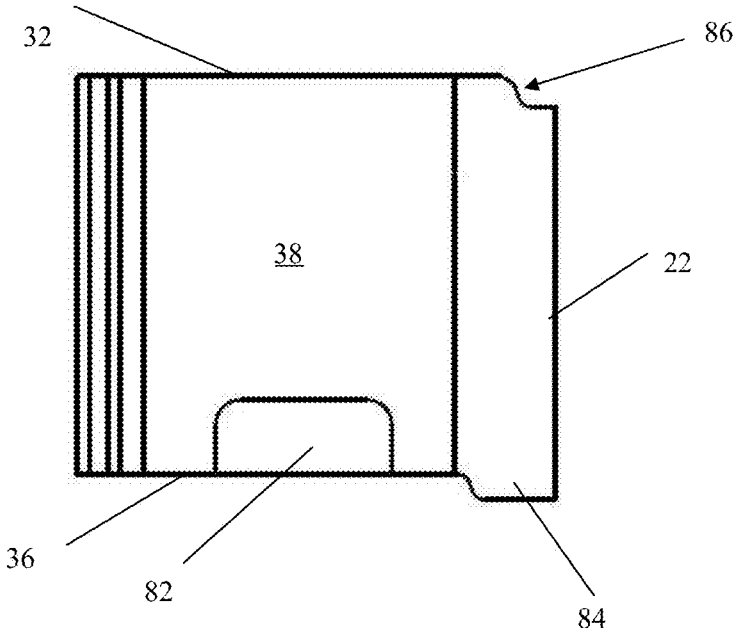
FIG. 4B is a side view of the anchor unit of FIG. 4A.
Figure 4C:
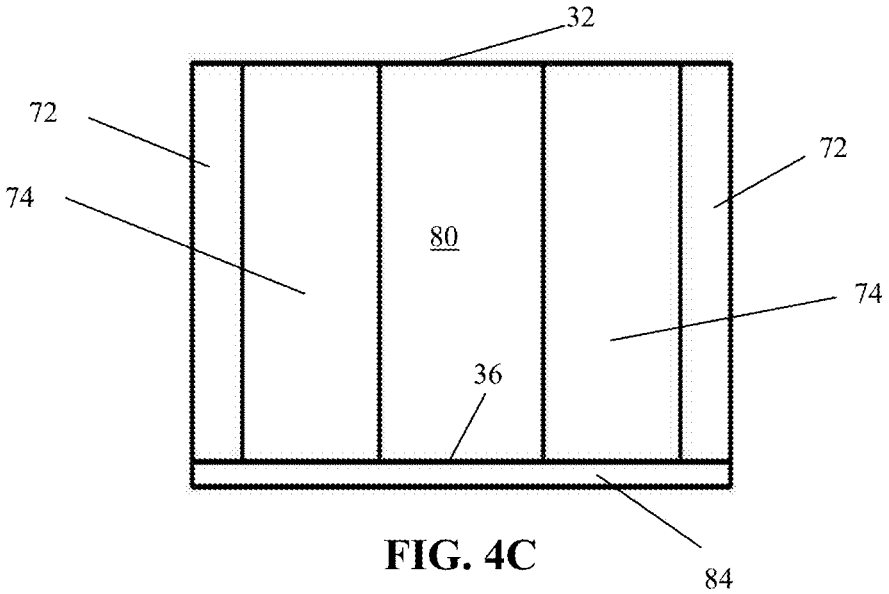
FIG. 4C is a front view of the anchor unit of FIG. 4A.
Figure 4D:
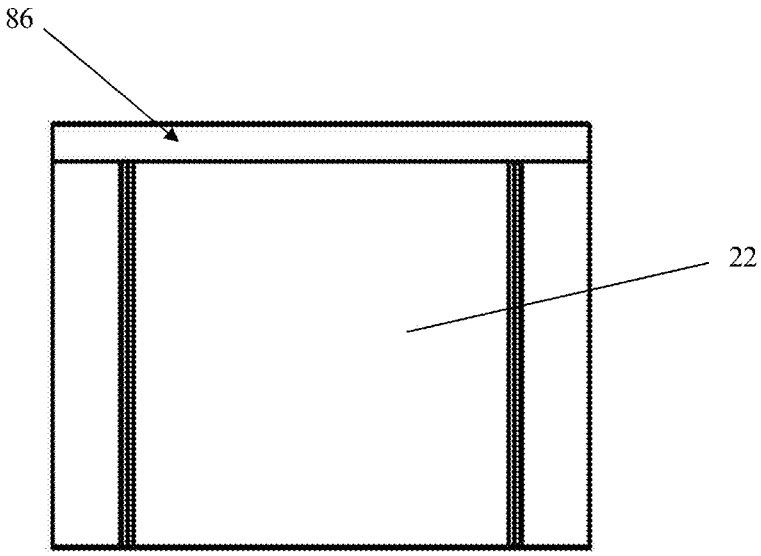
FIG. 4D is a rear view of the anchor unit of FIG. 4A.

FIG. 4A is a bottom view of an anchor unit 26 of a multi-component SRW block according to some embodiments of the present invention. FIG. 4B is a side view of the anchor unit 26 of FIG. 4A. FIG. 4C is a front view of the anchor unit 26 of FIG. 4A. FIG. 4D is a rear view of the anchor unit 26 of FIG. 4A. From the perspective of the top view in FIG. 4A, anchor unit 26 has a generally U-shape having a first leg 60 and second leg 62 interconnected by a back segment 66. The back segment 66 has a back side 22 that forms the back surface of the SRW block and confronts soil being retained by the retaining wall. The first leg 60 and second leg 62 are inset from the side ends 68 of the back segment 66, and are therefore connected via a central portion 70 of the back segment 66. Accordingly, the back segment 66 also includes outer flanges 72 that extend outward of the central portion 70. The width of the back segment 66 is slightly narrower than that of the widest portion of the face unit such that a retaining wall constructed of such anchor units and face units may form a convex curve (from the perspective of the front). The relatively narrower back segments 66 provide adequate relief to allow the face units to be angled relative to each other without interference from the anchor units 26. In certain embodiments, the back segment 66 extends approximately the same width as the back face of the face unit. In alternate embodiments, the outer flanges 72 are eliminated and the back segment 66 only includes the central portion 70. In the embodiment shown, the first leg 60 and second leg 62 terminate in respective connector elements 74. The connector elements 74 are shaped as hammer-head keys that extends the entire height of the anchor unit 26. It is understood, however, that the keys need not extend the entire height of the anchor unit 26. The connector elements are of complementary shapes to the face unit connector elements for interconnection therewith. The two connector elements 74 are of the same shape and/or size. It is understood, though, that connector elements 74 may be of different shapes and/or sizes as long as the connector elements of the face unit are constructed of complementary shapes and/or sizes for interconnection therewith. For instance, the connector shape could be circular instead of a flat hammer-head.

First leg 60 and second leg 62 of the anchor unit 26 form outer side walls 38 of the SRW block. In the embodiment shown, the side walls 38 extend the entire height of the anchor unit 26, from a lower load bearing surface 36 of the anchor unit to an upper load bearing surface 32 of the anchor unit. The load bearing surfaces 32, 36 are substantially planar, parallel to each other, and each formed transversely to the back segment. The upper surface 32 mates with and supports the lower surface 36 of a super-imposed stacked SRW block. As noted above, when a face unit and an anchor unit are interlocked, as shown in FIGS. 2A and 2B, the multi-component SRW formed contains a hollow core 40. The hollow core is formed, in part, by an inner wall 76 of the first leg, an inner wall 78 of the second leg 62, and the front wall of the back segment 80. In some anchor unit embodiments, the first leg 60 and the second leg 62 include hand-holds 82 useful when lifting the anchor units 26. In the embodiment shown, hand-holds 82 are formed as recesses on the bottom of the outside walls 38. The hand-holds 82 may also be formed as protrusions and they may be located at convenient locations other than the bottom of the outside walls (e.g., midway up or at the top of the outside walls).

Similar to face units, anchor units may also be manufactured with one or more alignment elements, including a lip, notch, pin recess, and a slot. In the embodiment shown in FIGS. 4A-4D, anchor unit 26 includes two alignment elements. One alignment element is formed as a lip 84 extending laterally across the width of the otherwise flat lower surface of the face unit 24 at the back of the back segment 66. The second alignment element is a notch 86 extending laterally across the width of the otherwise flat upper surface 32 of the anchor unit 26 at the back of the upper surface 32. Accordingly, the setback depth of each course of blocks is based on the difference in depths between the laterally extending lip 84 and the notch 86 of anchor unit 26. Of course, anchor units may be manufactured without any alignment element. In such a case, any setback is based on a lip or notch or other element on the corresponding face unit.

Figure 5:
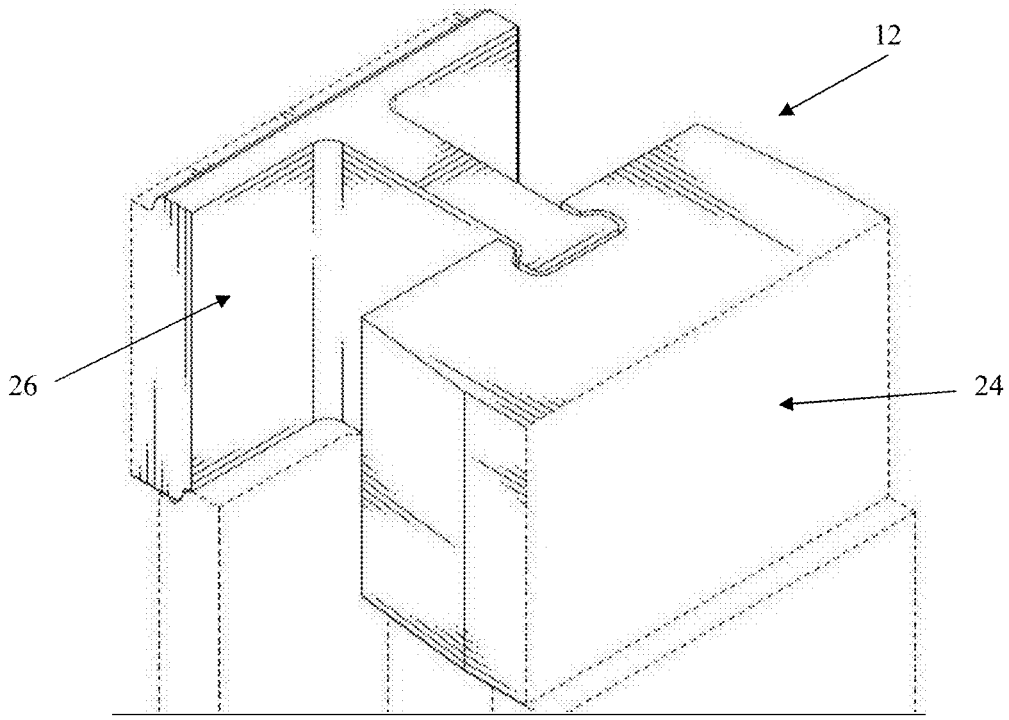
FIG. 5 is a front perspective view of a multi-component SRW block according to some alternate embodiments of the present invention.

FIG. 5 is a front perspective view of a multi-component SRW block 12 according to some alternate embodiments of the present invention. As shown, the SRW block 12 differs from the embodiments described above in that the face unit 24 and anchor unit 26 are interlocked together via only one of the connector elements described above. Of course, many different shapes and sizes of anchor units and face units (e.g., wider, narrower, deeper, shallower, more than two connector elements, anchor units and face units with differing numbers of connector elements, etc.) may be substituted and still fall within the scope of the invention.

Figure 6:
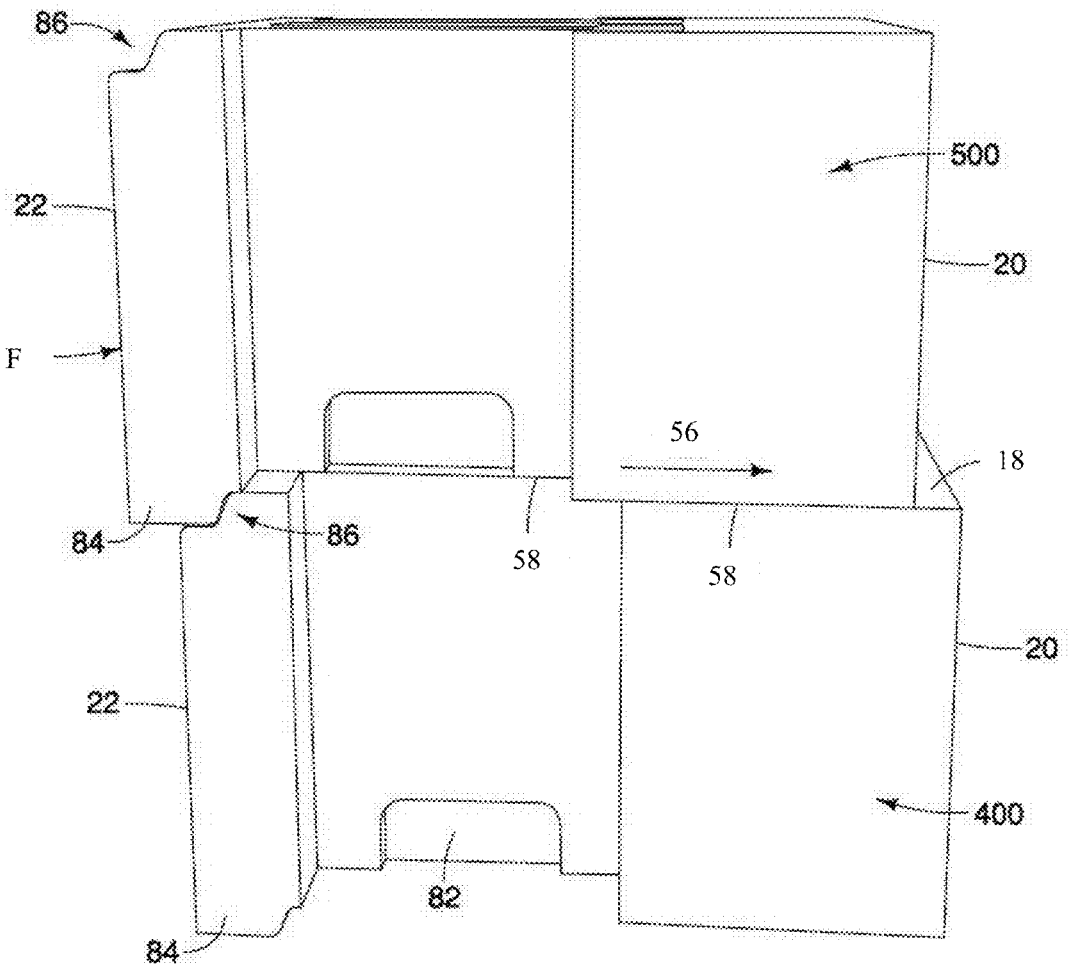
FIG. 6 is a side view of two of multi-component SRW blocks stacked atop each other.

FIG. 6 is a side view of a plurality of multi-component SRW blocks, as described herein, stacked atop each other to form a wall (or at least a portion of a wall). Block 400 is in the first course of blocks and block 500 is in the second course of blocks. Of course, any number of courses is within the scope of the present invention. Block 500 is assembled with a setback 18 relative to block 400. As described further below, any level of setback, including no setback, is within the scope of the present invention. The front faces 20 of blocks 400, 500 are typically exposed. The back sides 22 of blocks 400, 500, however, are typically hidden from view and confront soil (not shown) being retained in place by the wall. The soil, of course, creates pressure on the back side 22 of SRW blocks as indicated by arrows 56, tending to push the SRW blocks 400, 500 forward. One or more features of the multi-component SRW blocks adds stabilization to the wall. For instance, as noted above, the anchor unit and face unit each have upper and lower load bearing surfaces for mating with the lower load bearing surfaces of super-imposed stacked block. The load bearing surfaces may be generally planar or otherwise conforming to each other to increase physical contact. As shown by the interface 58 between blocks 400, 500, since the upper load bearing surface of block 400 and the lower load bearing surface of block 500 are generally planar, the surface area at the interface 58 is increased in order to provide a sufficient coefficient of static friction to resist the shear forces F applied by the soil that might otherwise cause block 500 to slide forward along the upper load bearing surface of block 400. Such planar surfaces add stabilization to the wall. In addition, as shown in FIG. 6, blocks 400, 500 include a lip 84 and a notch 86. As described above with reference to FIGS. 4A-4D, lip 84 extends laterally under the anchor units and at the rear thereof. Notch 86 extends laterally extends laterally over the anchor units and at the rear thereof. As noted above, the confrontation of the lip 84 on block 500 with the notch 86 on block 400 creates the setback 18. In addition, the lip and notch further stabilize the wall. The same confrontation of the lip 84 on block 500 with the notch 86 on block 400 resists the shear forces F applied by the soil that might otherwise cause block 500 to slide forward along the upper load bearing surface of block 400.

Face units and anchor units may be manufactured using many different methods, including wetcast, drycast, or an extrusion. For instance, the face unit or the anchor unit can be made through a process similar to that taught in Gravier, U.S. Pat. No. 5,484,236, the disclosure of which is incorporated herein by reference. An upwardly open mold box having walls defining one or more of the exterior surfaces of the block components is positioned on a conveyor belt. A removable top mold portion is configured to match other surfaces of the block component. A zero slump concrete slurry is poured into the mold and the top mold portion is inserted, with care being taken to distribute the slurry throughout the interior of the mold, following which the top mold portion is removed, as are the front, rear and side walls of the mold box, and the block components are allowed to fully cure. Any reference to "top" or "upper" may in fact be the bottom, lower, or any other surface as the blocks are ultimately oriented. The same applies to references to bottom, front, lower, and side surfaces. In some embodiments in accordance with the invention, core bars of various sizes may be used to create anchor units and face units. For instance, core bars may be used to create the alignment elements discussed herein, including lips, notches, pin recesses, and slots. Core pulling techniques such as disclosed in U.S. Pat. No. 5,484,236, entitled "METHOD OF FORMING CONCRETE RETAINING WALL BLOCK", assigned to the same assignee as the present invention, may be employed in production.

Since the block components are smaller than fully assembled blocks, multiple components may be formed at a time in a single mold box. In embodiments of the present invention, it is possible that multiple composite blocks may be formed, where the composite blocks are split into face units with textured stacking surfaces. Surfaces of the mold box or the surface of a divider plate inserted into the mold box may be embossed with different patterns so that the stacking surfaces of the face units may be embossed with a pattern.

Independent of the manufacturing process used, the face units may be formed of different materials than those used for the anchor units. Both may be formed of concrete, but the anchor units may use a higher percentage of recycled materials. Alternatively, the face unit may be formed of concrete while the anchor unit is formed of plastic.

Figure 7:
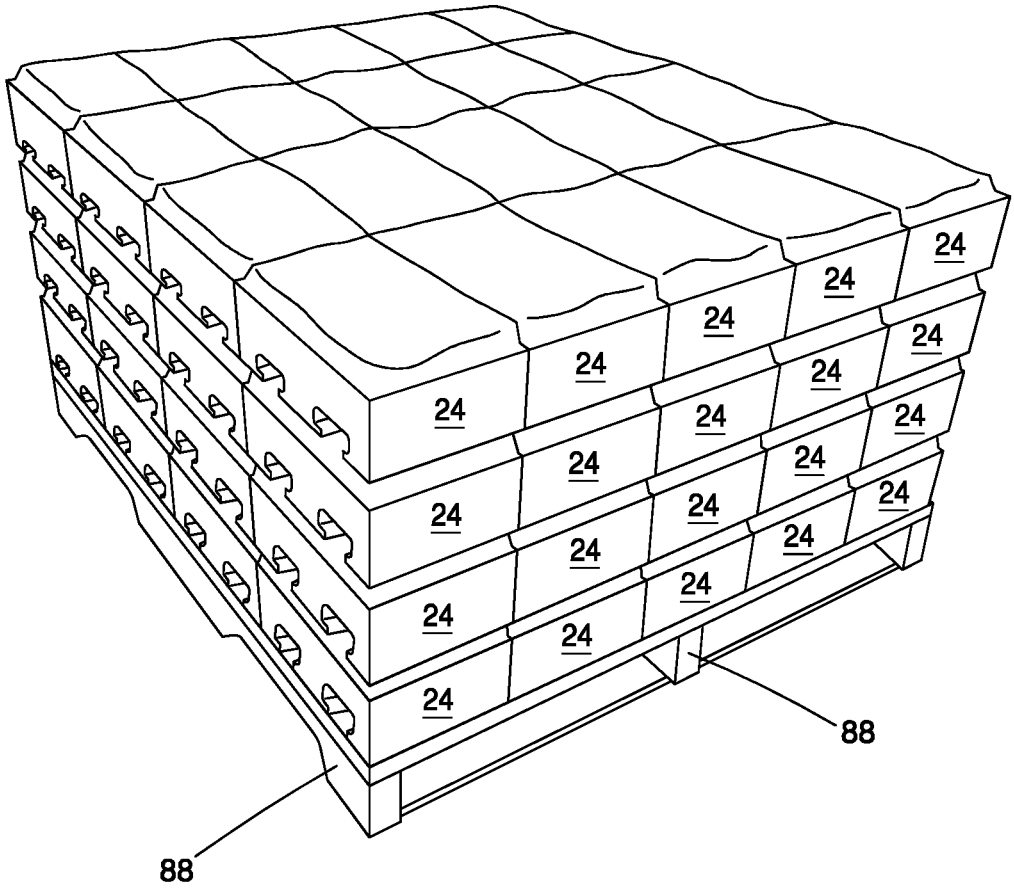
FIG. 7 is a front perspective view of several face units according to some embodiments of the present invention stacked on a pallet.

SRW blocks are likely manufactured some distance away from the site where they will be assembled into a retaining wall. Accordingly, the SRW blocks must be transported to the installation location. FIG. 7 is a front perspective view of sixty stacked face units 24 according to some embodiments of the present invention. The face units 24, as shown, are stacked on each other and on a pallet 88. It is much easier to transport the face units 24 when they are stacked as shown in FIG. 7. The front surfaces of many types of SRW blocks are often designed to be irregular so that the SRW blocks better simulate natural stone. However, such surface irregularities can present problems when transporting SRW blocks. For instance, when the surface irregularities come in the form of differing block depths, the SRW blocks may not stack evenly.

Blocks that do not stack evenly can result in stacks that are not of uniform size. For instance, one row may lean heavily in a particular direction. This risks having the shipment not fit in or on its transporting vehicle. Of greater concern, though, are that blocks that do not stack evenly may be less stable than desired. That is, irregular surfaces sometimes do not provide a stable base for subsequently stacked layers.

Figure 8A:
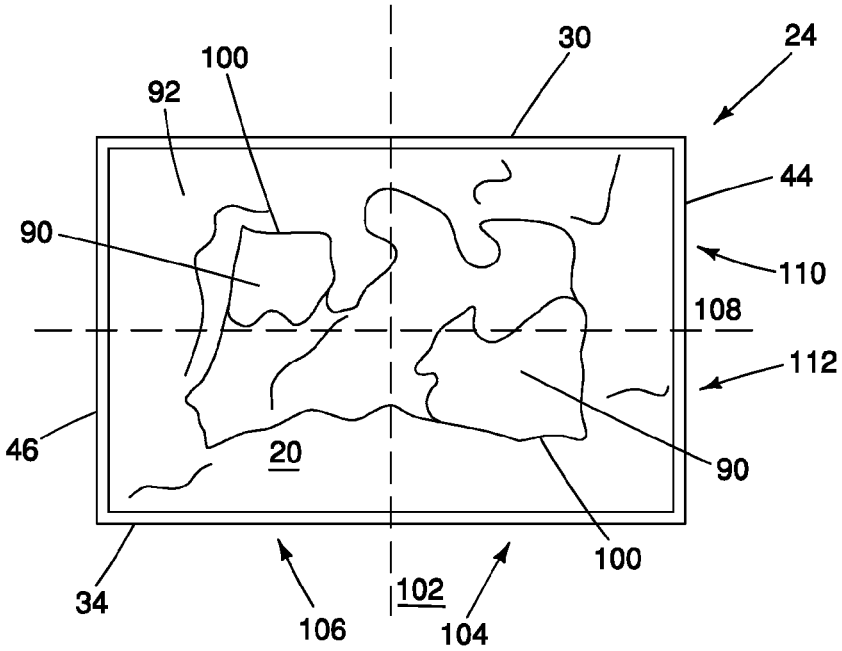
FIG. 8A is a front view of a face unit of a multi-component SRW block according to some embodiments of the present invention.
Figure 8B:
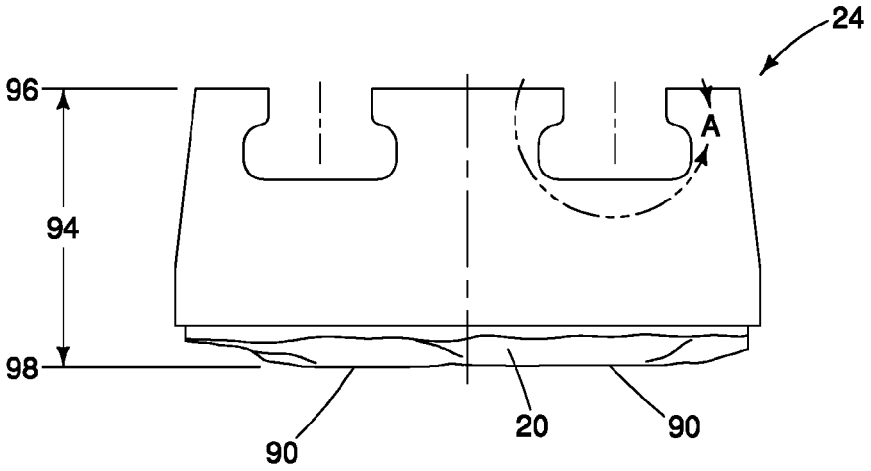
FIG. 8B is a top view of the face unit of FIG. 8A.

Embodiments of the present invention provide greater natural stability and increased uniformity when stacked together for shipping in a manner such as that shown in FIG. 7. FIG. 8A is a front view of a face unit of a multi-component SRW block according to some embodiments of the present invention. FIG. 8B is a top view of the face unit of FIG. 8A. The face unit 24 of FIGS. 8A and 8B is similar to the face units 24 shown in the other drawing figures and its features are numbered similarly. The front face 20 of face unit 24 includes two stacking surfaces 90 and an irregular surface 92. The irregular surface 92 simulates natural stone. The stacking surfaces 90 are generally flat surfaces and are coplanar. The stacking surfaces 90 are generally transverse to the upper 30 and lower 34 surfaces and are parallel to the front 20 and rear 28 faces. As described further below, portions of the stacking surfaces 90 may be located directly opposite flat portions of the rear face 28 in order to enhance the stability of the face units 24 when stacked for shipment.

In the embodiment shown in FIG. 8B, the stacking surfaces 90 are located on the furthest forward extent of the face unit 24. That is, the maximum depth 94 of the face unit 24 is measured from the depth 96 of the rear face 28 to the depth 98 of the stacking surface 90. Accordingly, the stacking surfaces 90 provide the portions of the front face that confronts other blocks when such blocks are stacked on the front face.

In certain embodiments, such as that shown in FIG. 8A, each stacking surface 90 is defined by an irregular perimeter 100 so as to better simulate natural stone. Moreover, the remainder of the front face 20 of face unit 24 includes an irregular surface 92 which also simulates natural stone. Thus, since the flat stacking surfaces 90 are bounded by irregular perimeters 100 and sit within otherwise irregularly patterned front surfaces 92, the flat stacking surfaces 90 should visually blend into the front face 24 and not destroy the simulation of natural stone.

The placement of the stacking surfaces is one manner of increasing the stability of the stack of face units when stacked, such as in FIG. 7, for shipping. As described herein, the placement may include distributing the stacking surface(s) over multiple portions of the stacking surface(s). The placement may include distributing the stacking surface(s) towards the outer perimeter of the front face. Referring specifically to FIG. 8A, centerline 102 is shown as a dotted line which splits the face unit 24 into right 104 and left 106 halves. In addition, centerline 108, shown as a dotted line, splits the face unit 24 in upper 110 and lower 112 halves. In the embodiment shown in FIG. 8A, at least one stacking surface is located on the right half 104 and one stacking surface is located on the left half 106. Of course, the same benefit is achieved, and is therefore within the scope of the present invention, if the same one stacking surface is located, in part, on both the right half 104 and the left half 106. In the embodiment shown in FIG. 8A, at least one stacking surface is located on the upper half 110 and one stacking surface is located on the lower half 112. Of course, the same benefit is achieved, and is therefore within the scope of the present invention, if the same one stacking surface is located, in part, on both the upper half 110 and the lower half 112. The concept of a portion or a part of a stacking surface is explained further below with reference to FIG. 9.

Figure 9:
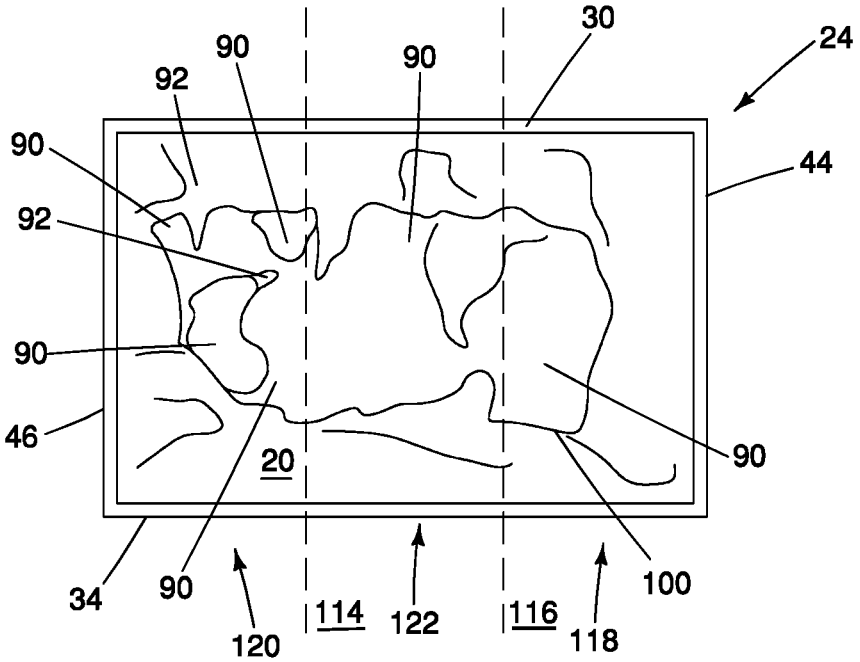
FIG. 9 is a front view of a face unit of a multi-component SRW block according to some alternate embodiments of the present invention.

FIG. 9 is a front view of a face unit of a multi-component SRW block according to some alternate embodiments of the present invention. The face unit 24 of FIG. 9 is similar to the face units 24 shown in the other drawing figures and its features are numbered similarly. The front face 20 of face unit 24 includes multiple stacking surfaces 90 and an irregular surface 92. The irregular surface 92 simulates natural stone. The stacking surfaces 90 are generally flat surfaces and are coplanar. The stacking surfaces 90 are located on the furthest forward extent of the face unit 24. The stacking surfaces 90 are generally transverse to the upper 30 and lower 34 surfaces and are parallel to the front 20 and rear 28 faces. As described further below, portions of the stacking surfaces 90 may be located directly opposite flat portions of the rear face 28 in order to enhance the stability of the face units 24 when stacked for shipment. In certain embodiments, such as that shown in FIG. 9, each stacking surface 90 is defined by an irregular perimeter 100 so as to better simulate natural stone. Moreover, the remainder of the front face 20 of face unit 24 includes an irregular pattern 92 which also simulates natural stone.

Dividing line 114 and dividing line 116 are shown as dotted lines which separate the face unit 24 into a right third 118, left third 120, and center third 122. In the embodiment shown in FIG. 9, at least one stacking surface is located on the right third 118 and one stacking surface is located on the left third 120. In addition, at least one stacking surface 90 is located, in part, on both the right third 118 and the center third 122. Of course, such stacking surface 90 could also extend into the left third 120, even if the connection was seen as merely a narrow isthmus connecting other portions of the stacking surface 90. In other embodiments, the stacking surfaces may comprise three, relatively smaller stacking surfaces that are distributed about the front face 20 in a non-linear manner similar to the three legs of a bar stool (e.g., three non-linear points defining a plane) so as to increase the stability of the stacked face units.

Figure 10:
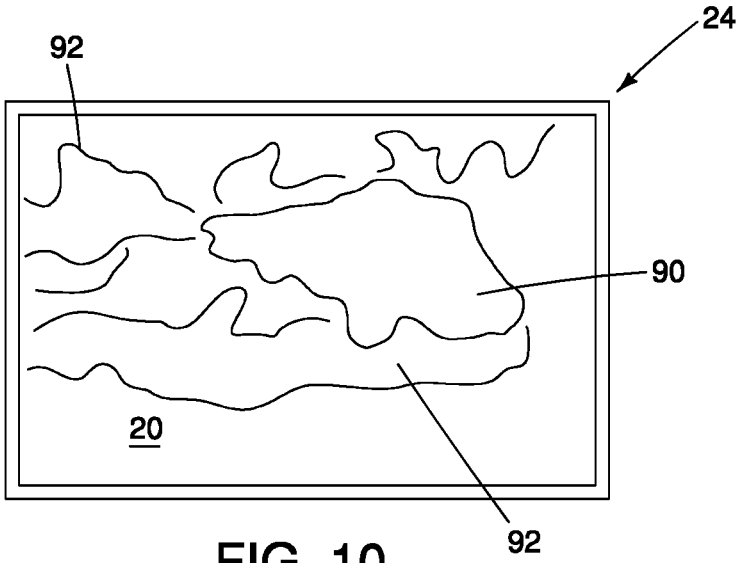
FIG. 10 is a front view of a face unit of a multi-component SRW block according to some alternate embodiments of the present invention.

Increasing the total area of the stacking surfaces is one manner of increasing the stability of the stack of face units when stacked, such as in FIG. 7, for shipping. FIG. 10 is a front view of a face unit 24 of a multi-component SRW block according to some alternate embodiments of the present invention. The face unit 24 of FIG. 10 is similar to the face units 24 shown in the other drawing figures and its features are numbered similarly. The front face 20 of face unit 24 includes one stacking surface 90 and an irregular surface 92. The irregular surface 92 simulates natural stone. The stacking surfaces 90 are generally flat surfaces and are coplanar. The stacking surfaces 90 are located on the furthest forward extent of the face unit 24. The stacking surfaces 90 are generally transverse to the upper 30 and lower 34 surfaces and are parallel to the front 20 and rear 28 faces. As described further below, portions of the stacking surfaces 90 may be located directly opposite flat portions of the rear face 28 in order to enhance the stability of the face units 24 when stacked for shipment. In certain embodiments, such as that shown in FIG. 10, each stacking surface 90 is defined by an irregular perimeter so as to better simulate natural stone. Moreover, the remainder of the front face 20 of face unit 24 includes an irregular pattern 92 which also simulates natural stone. In the embodiment shown in FIG. 10, the stacking surface extends over about 15-20% of the front face 20. In certain embodiments, at least one stacking surface extends over at least 15% of the front face 20. In other embodiments, the total area of all the stacking surfaces equals at least 15% of the front face 20. In other embodiments, the total area of all the stacking surfaces equals at least 20% of the front face 20. In some embodiments, the relative amount of stacking surface may be smaller. For instance, in some embodiments, the total area of all the stacking surfaces equals between 5-15% of the area of the front face.

Figure 11:
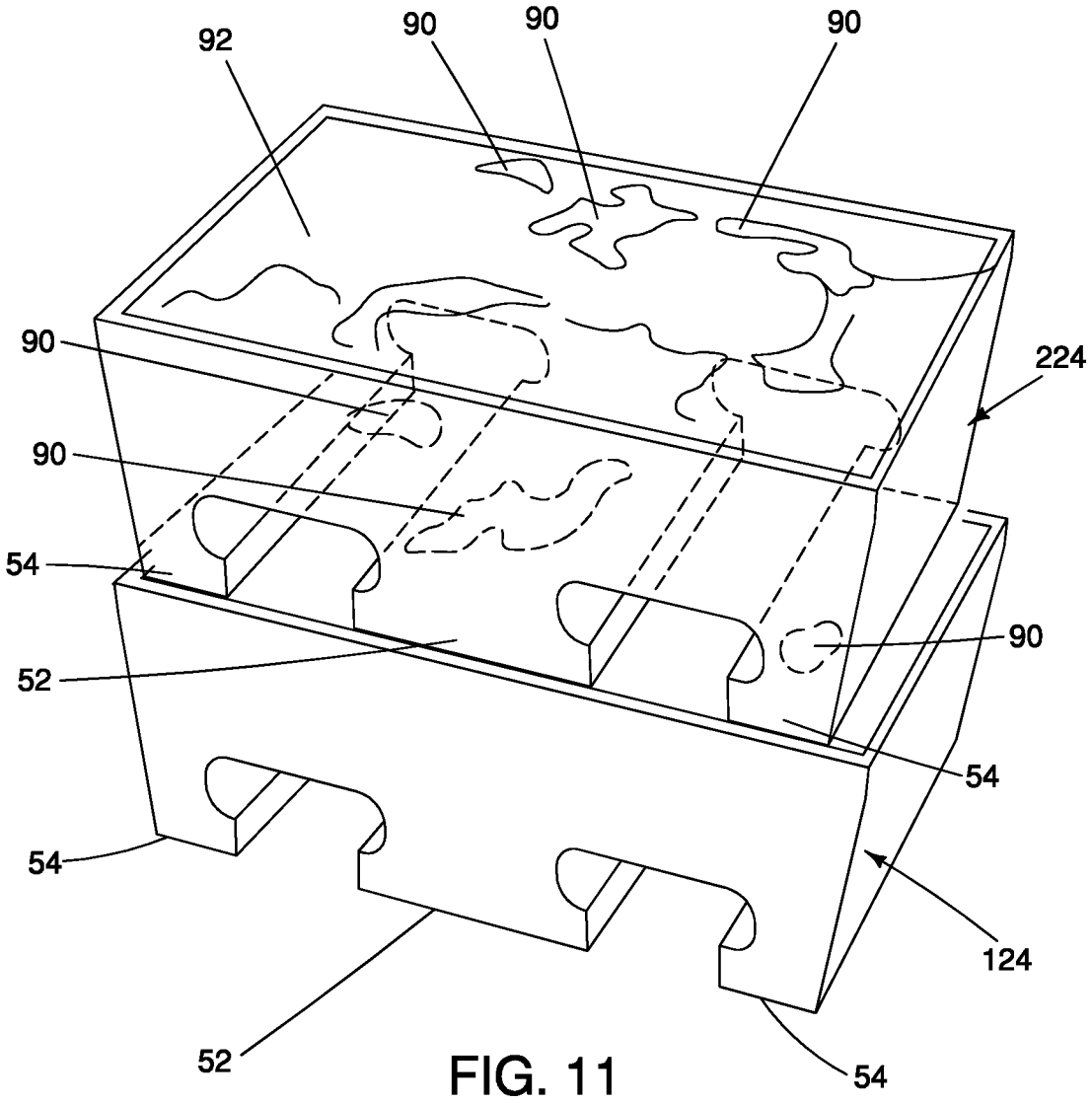
FIG. 11 is a front perspective view of two face units according to some embodiments of the present invention positioned in a stacked configuration for shipment.

FIG. 11 is a front perspective view of two face units according to some embodiments of the present invention positioned in a stacked configuration, such as that shown in FIG. 7, for shipment. FIG. 11 includes a lower face unit 124 and an upper face unit 224. Each face unit includes multiple stacking surfaces 90 that are pictured with dark shading to highlight their location. The upper face unit 224 is shown in transparent form to help visualize the stacking surfaces on the lower face unit 124 and to show how the rear face 28 on the upper face unit 224 confronts the front face 20 on the lower face unit 124. The transparency also helps visualize how the flat portions of the rear face 28 of the upper face unit 224 confront portions of one or more of the stacking surfaces on the lower face unit 124. For instance, as shown, central flat portion 52 of upper face unit 224 confronts one of the stacking surfaces 90 on lower face unit 124. In addition, outer flat portions 54 of upper face unit 224 (which are coplanar with the central flat portion 52) confront respective stacking surfaces on lower face unit 124. Accordingly, since the central 52 and outer 54 flat portions of the rear face 28 are the same in the upper 224 and lower 124 face units, portions of the stacking surfaces 90 are positioned directly opposite flat portions of the rear face 28. By providing confronting planar surfaces on the upper 224 and lower 124 face units 24, the stability of stack of face units is improved. Such stacks are less likely to tip. The stack of face units is unlikely to lean in a particular direction. The stacks should rise all rise vertically when stacked for shipment and provide a predictable height and associated girth.

As noted above, the front face 20 of face units 24 may have a pattern molded or formed thereon. The pattern may be created based on correspondingly embossed patterned surfaces of the mold box or surfaces of a divider plate inserted into the mold box, as described above. The patterns for the surfaces of the mold box or divider plates may be computer-generated and they may be based on existing, natural stone surfaces. For instance, the three-dimensional pattern of a natural stone surface may be machine scanned, for instance with a commercial laser scanner, to develop a digital image data file representative of the three-dimensional pattern. The image may then be modified using CAD software to create the one or more stacking surfaces. For instance, the forward protrusion or forward extension of the scanned three-dimensional pattern could be truncated or clipped at a certain extension, leaving flat, coplanar portions in all areas of the front surface that meet or exceed the forward extension limit. The surfaces of the mold box or of the divider plate could then be embossed using the modified three-dimensional pattern in order to create face units with the stacking surfaces.

In the foregoing detailed description, the invention has been described with reference to specific embodiments. However, it may be appreciated that various modifications and changes can be made without departing from the scope of the invention as set forth in the appended claims.

The invention claimed is:

1. A mortarless retaining wall constructed of a plurality of segmental retaining wall (SRW) blocks stacked in an array of superimposed rows, each SRW block comprising:

a face unit having a front face and a rear face, the front face defining at least part of the exposed surface of the retaining wall, the rear face being located opposite the front face, the face unit having connectors;

one or more anchor units each having connectors, the anchor unit connectors being of complementary shape to interlock with respective face unit connectors, the face unit and the one or more anchor units forming the SRW block when interlocked, each anchor unit for confronting soil being retained by the retaining wall, the face unit and each anchor unit each having upper and lower load bearing surfaces, the upper load bearing surfaces shaped to mate with the lower load bearing surfaces of a super-imposed stacked SRW block and resisting shear forces between surrounding SRW blocks, the shear forces generated by the soil retained by the retaining wall against the SRW blocks;

a portion of the rear face including a generally planar rear surface; and a portion of the front face including one or more generally flat stacking surfaces, the one or more stacking surfaces each being coplanar with each other and oriented in parallel to the generally planar rear surface, the maximum depth of the face unit being the distance between the stacking surfaces and the rear surface, the one or more stacking surfaces, when stacked on or under another face unit, providing stability to a stack of face units when stacked for shipment, the front face including an irregularly patterned surface simulating natural stone, the irregularly patterned surface extending from one or more of the stacking surfaces about at least a portion of the perimeter thereof in a direction toward the rear face.

2. The mortarless retaining wall of claim 1, wherein the stacking surfaces are each defined by irregular perimeters.

3. The mortarless retaining wall of claim 1, wherein the one or more stacking surfaces include at least three stacking surfaces.

4. The mortarless retaining wall of claim 1, wherein the front face defines a right half-face and a left half-face separated by a line that extends between the load bearing surfaces and bisects the front face, the stacking surfaces being located on both the right half-face and the left half-face.

5. The mortarless retaining wall of claim 1, wherein the front face defines an upper half-face and a lower half-face separated by a line that extends between opposing right and left ends of the face unit and bisects the front face, the stacking surfaces being located on both the upper half-face and the lower half-face.

6. The mortarless retaining wall of claim 1, wherein the front face defines a rightmost one-third face and a leftmost one-third face separated by a central one-third face, the one-third faces defined by lines extending between the load bearing surfaces and together trisecting the front face, the stacking surfaces being located on both the rightmost one-third face and the leftmost one-third face.

7. The mortarless retaining wall of claim 1, wherein the one or more stacking surfaces comprise at least 20% of the front face.

8. The mortarless retaining wall of claim 1, wherein the one or more stacking surfaces comprise less than 80% of the front face.

9. The mortarless retaining wall of claim 1, the rear face having recesses extending towards the front face and forming the connector elements.

10. The mortarless retaining wall of claim 1, wherein the one or more stacking surfaces are separated by the irregularly patterned surface.

11. A plurality of segmental retaining wall (SRW) blocks for stacking in an array of superimposed rows to form a retaining wall, each SRW block comprising:

a face unit having a front face and a rear face, the front face defining at least part of the exposed surface of the retaining wall, the rear face being located opposite the front face, the face unit having connectors;

one or more anchor units each having connectors, the anchor unit connectors being of complementary shape to interlock with respective face unit connectors, the face unit and the one or more anchor units forming the SRW block when interlocked, each anchor unit for confronting soil being retained by the retaining wall, the face unit and each anchor unit each having upper and lower load bearing surfaces, the upper load bearing surfaces shaped to mate with the lower load bearing surfaces of a super-imposed stacked SRW block and resisting shear forces between surrounding SRW blocks, the shear forces generated by the soil retained by the retaining wall against the SRW blocks;

a portion of the rear face including a generally planar rear surface; and a portion of the front face including one or more generally flat stacking surfaces, the one or more stacking surfaces each being coplanar with each other and oriented in parallel to the generally planar rear surface, the maximum depth of the face unit being the distance between the stacking surfaces and the rear surface, the one or more stacking surfaces, when stacked on or under another face unit, providing stability to a stack of face units when stacked for shipment, the front face including non-planar surfaces, the non-planar surfaces extending from one or more of the stacking surfaces about at least a portion of the perimeter thereof in a direction toward the rear face.

12. The plurality of SRW blocks of claim 11, wherein the front face defines a right half-face and a left half-face separated by a line that extends between the load bearing surfaces and bisects the front face, the stacking surfaces being located on both the right half-face and the left half-face.

13. The plurality of SRW blocks of claim 11, wherein the front face defines an upper half-face and a lower half-face separated by a line that extends between opposing right and left ends of the face unit and bisects the front face, the stacking surfaces being located on both the upper half-face and the lower half-face.

14. The plurality of SRW blocks of claim 11, wherein the front face defines a rightmost one-third face and a leftmost one-third face separated by a central one-third face, the one-third faces defined by lines extending between the load bearing surfaces and together trisecting the front face, the stacking surfaces being located on both the rightmost one-third face and the leftmost one-third face.

15. A plurality of segmental retaining wall (SRW) blocks for stacking in an array of superimposed rows to form a retaining wall, each SRW block comprising:

a face unit having a front face and a rear face, the front face defining at least part of the exposed surface of the retaining wall, the rear face being located opposite the front face, the face unit having connectors;

one or more anchor units each having connectors, the anchor unit connectors being of complementary shape to interlock with respective face unit connectors, the face unit and the one or more anchor units forming the SRW block when interlocked, each anchor unit for confronting soil being retained by the retaining wall;

a portion of the rear face including a generally planar rear surface; and a portion of the front face including one or more generally flat stacking surfaces, the one or more stacking surfaces each being coplanar, oriented in parallel to the generally planar rear surface, and defined by irregular perimeters, the maximum depth of the face unit being the distance between the stacking surfaces and the rear surface, the one or more stacking surfaces, when stacked on or under another face unit, providing stability to a stack of face units when stacked for shipment, the front face including non-planar surfaces, the non-planar surfaces extending from one or more of the stacking surfaces about at least a portion of the perimeter thereof in a direction toward the rear face.

16. The plurality of SRW blocks of claim 15, wherein the one or more stacking surfaces comprise at least 20% of the front face.

17. The plurality of SRW blocks of claim 15, wherein the one or more stacking surfaces comprise less than 80% of the front face.

18. The plurality of SRW blocks of claim 15, the rear face having recesses extending towards the front face and forming the connector elements.

19. The plurality of SRW blocks of claim 15, wherein the one or more stacking surfaces are separated by the irregularly patterned surface.

* * * * *